US007918245B2

(12) United States Patent
Staudinger et al.

(10) Patent No.: US 7,918,245 B2
(45) Date of Patent: Apr. 5, 2011

(54) HYDRAULIC PRESSURE RESERVOIR

(75) Inventors: Martin Staudinger, Ettlingen (DE); Marco Grethel, Bühlertal (DE); Felix Dreher, Staufen im Breisgau (DE); Franz Benz, Achern (DE)

(73) Assignee: LuK Lamellen und Kupplungsbau Beteiligungs KG, Bühl (DE)

( * ) Notice: Subject to any disclaimer, the term of this patent is extended or adjusted under 35 U.S.C. 154(b) by 327 days.

(21) Appl. No.: 12/080,258

(22) Filed: Apr. 1, 2008

(65) Prior Publication Data

US 2008/0257439 A1 Oct. 23, 2008

Related U.S. Application Data

(60) Provisional application No. 60/922,063, filed on Apr. 5, 2007.

(51) Int. Cl.
*F15D 1/02* (2006.01)

(52) U.S. Cl. ..... 138/30; 138/26; 138/46; 137/565.34; 251/75

(58) Field of Classification Search ..... 138/30, 138/26; 137/565.34; 251/75
See application file for complete search history.

(56) References Cited

U.S. PATENT DOCUMENTS

| | | | | | |
|---|---|---|---|---|---|
| 3,641,882 | A * | 2/1972 | Hall | 92/171.1 |
| 3,867,963 | A * | 2/1975 | Ballard | 138/46 |
| 4,164,954 | A * | 8/1979 | Ballard | 137/116.3 |
| 4,477,092 | A * | 10/1984 | Bush | 277/322 |
| 4,967,800 | A * | 11/1990 | Heilmayr et al. | 138/162 |
| 6,561,522 | B1 * | 5/2003 | Radelet et al. | 277/628 |
| 7,074,044 | B2 * | 7/2006 | Billing et al. | 439/23 |
| 2006/0213572 | A1 * | 9/2006 | Beaulieu | 138/155 |
| 2007/0028981 | A1 | 2/2007 | Staudinger | 138/30 |

FOREIGN PATENT DOCUMENTS

| | | | |
|---|---|---|---|
| JP | 2008298286 | A * | 12/2008 |
| WO | WO 2007/000128 | A1 | 1/2007 |

* cited by examiner

*Primary Examiner* — Patrick F Brinson
(74) *Attorney, Agent, or Firm* — Alfred J. Mangels

(57) ABSTRACT

A hydraulic pressure reservoir having at least one pressure chamber formed between two opposed, movable inner boundary members. Each inner boundary members includes a spring cover and a diaphragm spring. An outer boundary member peripherally surrounds the movable inner boundary members and has a U-shaped cross section along at least a part of its periphery to axially support the diaphragm springs in a fixed axial position. The outer boundary member can be formed in several pieces that are held together by interconnections or by a surrounding outer tensioning member.

13 Claims, 4 Drawing Sheets

HYDRAULIC PRESSURE RESERVOIR

BACKGROUND OF THE INVENTION

1. Field of the Invention

The present invention relates to a hydraulic pressure reservoir having at least one pressure chamber that is formed between two opposed, movable boundary surfaces, each of which includes a spring cover, a diaphragm spring, and at least one free-standing boundary surface.

2. Description of the Related Art

A hydraulic pressure reservoir of this general type is known from International Published Application No. WO 2007/000128 A1. That publication discloses a spring-pressurized reservoir in which two diaphragm springs are clamped between two housing covers that are screwed to control plates.

A disadvantage of a hydraulic pressure reservoir in accordance with the existing art is the comparatively complex screwed connection, which in addition must be able to withstand very high tensile forces acting on the screws.

An object of the present invention is therefore to provide a hydraulic pressure reservoir of the above-indicated type that is simpler and less expensive to produce.

SUMMARY OF THE INVENTION

The object is achieved by a hydraulic pressure reservoir having at least one pressure chamber that is formed between two opposed, movable boundary surfaces. Each boundary surface includes a spring cover and a diaphragm spring, as well as at least one fixed boundary surface, where the fixed boundary surface over at least part of its periphery is a solid of revolution of a U-shaped cross section as the generating curve, and which fixes the diaphragm springs in the axial direction. The fixed boundary surface is thus cylindrical in shape over part of its axial extent, and includes regions at the end faces of the cylinder with which the outer perimeter of the diaphragm springs in the axial direction is fixed. To that end, it is preferably provided that the fixed boundary surface is a housing ring having a U-shaped cross section. That makes it possible to construct the pressure reservoir without screws that are loaded in the pressure direction of the diaphragm springs, as is required in the known devices.

The fixed boundary surface is constructed approximately like a steel strip that is bent at the top and bottom and is laid around the set of diaphragm springs. Preferably, the design also provides that the housing ring is in two parts, wherein the housing ring preferably includes two half-rings that are furthermore preferably divided by a plane that passes through the axis of rotation of the solid of revolution. The half-rings are preferably identical in construction.

To install the half-rings, they are placed around the pre-assembled spring set of the diaphragm springs that include spring covers, and are joined to each other. The connection is under load only in the circumferential direction of the solid of revolution. Forces that arise in the axial direction are absorbed by the housing ring itself.

The two half-rings are preferably joined together in a positive connection. The positive connection is preferably a dovetail joint. A connection of that type can be produced easily when manufacturing the half-rings, for example by stamping, and in addition is easy to assemble. The dovetail connection can be made by simply bending the half-rings upward slightly and sliding one over the other during assembly, and is self-locking thereafter. The dovetail joint preferably includes a dovetail on one of the half-rings and a correspondingly shaped recess on the other of the half-rings. Alternatively, it is also possible to provide dovetails and recesses one above the other in the axial direction on each end of the half-rings. The dovetail joint preferably includes means that fix the dovetail joint positively in the radial direction.

Once the connection has been made between the two half-rings, the axial compression force exerted by the diaphragm springs ensures that a tensile force arises in the circumferential direction of the half-rings, which fixes and locks the dovetail connection. To that end, lugs or projections or the like can be provided, for example on the dovetails, which prevent the dovetails from being pressed clear through the recesses. In that way the connection of the two half-rings is self-locking.

In another preferred exemplary embodiment of the invention, the housing ring can also be designed in three parts. If it is then divided into three parts in a plane in which the angle of rotation of the housing ring is situated, the housing ring includes three 120° ring segments.

In addition to the above-described joinder of the housing ring parts by means of a dovetail joint, the two-part or multi-part housing ring segments can also abut each other without a positive lock, in which case the connection is supported by means of a band or ring that surrounds the ring segments to secure them radially. Of course, a plurality of circumferential bands or tensioning rings can also be provided.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
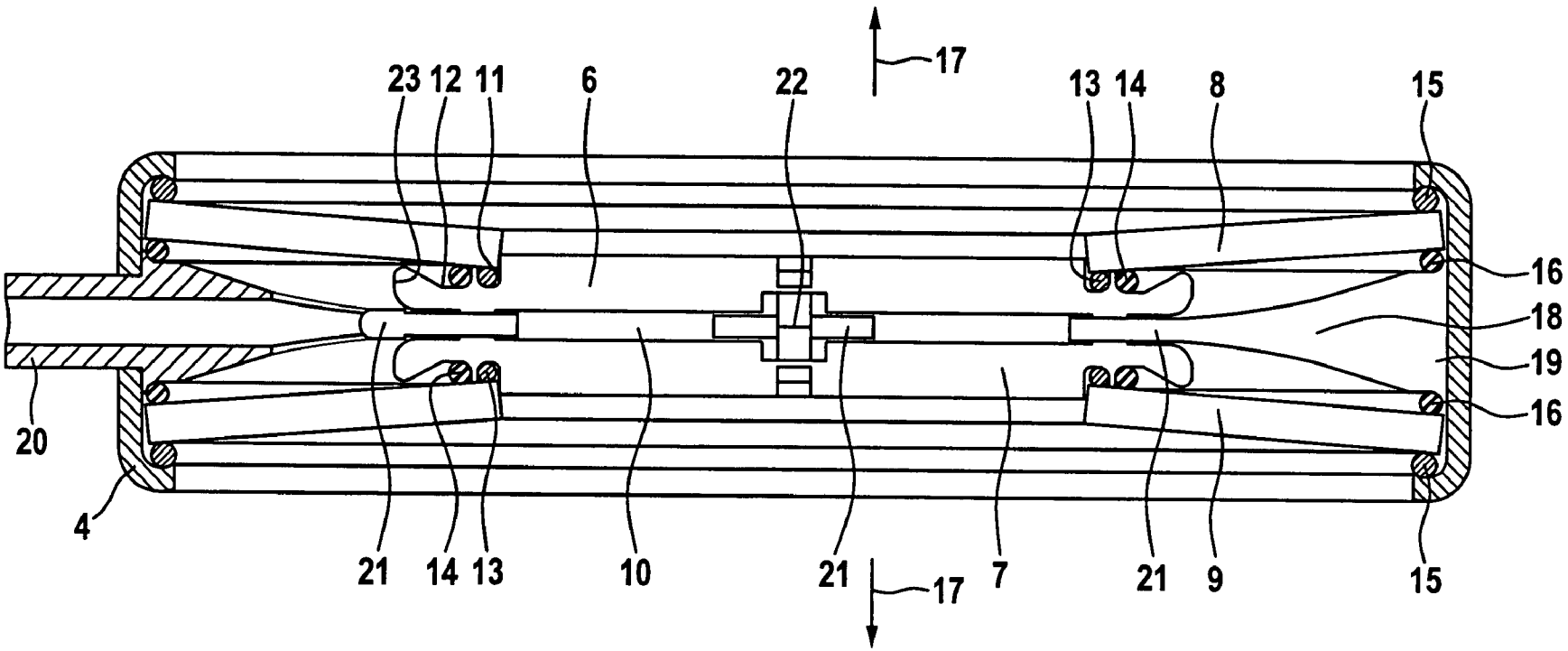
FIG. 1 is a longitudinal cross section through an exemplary embodiment of a pressure reservoir in accordance with the invention.
Figure 2:
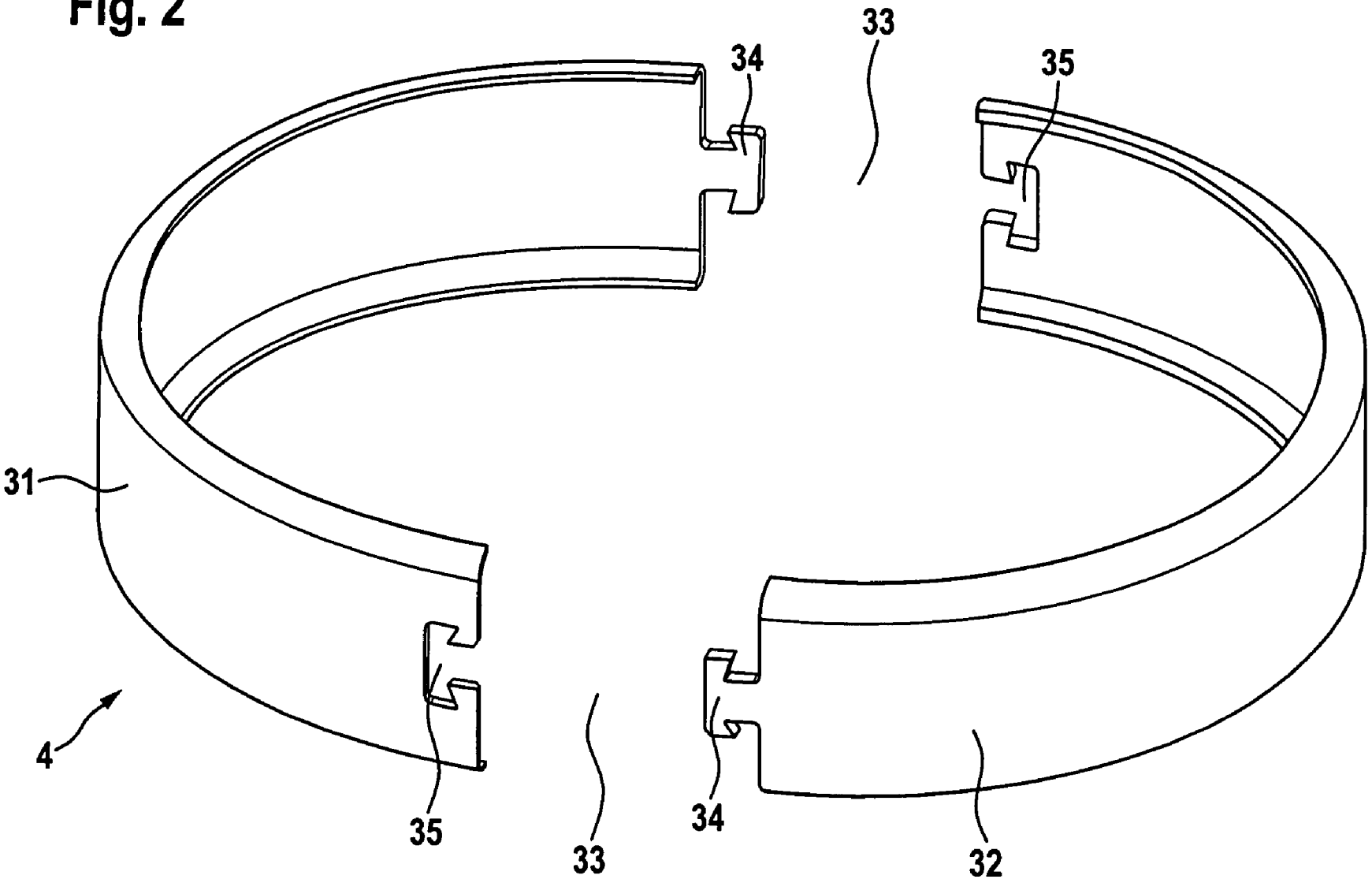
FIG. 2 is a perspective view of a two-piece housing ring of the pressure reservoir shown in FIG. 1.

FIG. 1 shows an exemplary embodiment of a pressure reservoir in cross section. The illustrated reservoir includes a housing ring 4, which is an essentially U-shaped profile from which a solid of revolution in accordance with FIG. 2 is formed. The housing ring 4 encircles two diaphragm springs 8 and 9, which press two spring covers 6 and 7 in the direction of a pressure chamber 10. An upper diaphragm spring 8 interacts with an upper spring cover 6 and, correspondingly, a lower diaphragm spring 9 interacts with a lower spring cover 7. Upper spring cover 6 and lower spring cover 7 are identical in construction; correspondingly, upper diaphragm spring 8 and lower diaphragm spring 9 are identical in construction. In the following explanation, the construction of the spring covers and diaphragm springs will therefore be described only on the basis of upper diaphragm spring 8 and upper spring cover 6.

Spring cover 6 includes two adjacent annular grooves in its radially outer region, namely an inner annular groove 11 that has an essentially rectangular cross section, and an outer annular groove 12 that has an essentially rectangular cross section in its radially inner area and which changes to a trapezoidal region with a stop 23 radially toward the outside. Inner annular groove 11 receives a cover-mounted pivot ring 13, and outer annular groove 12 receives a cover-mounted sealing ring 14. Diaphragm spring 8 is supported on the housing side on a housing-mounted pivot ring 15, and is sealed from the environment by a housing-mounted sealing ring 16.

If a hydraulic pressure p is built up within pressure chamber 10, spring covers 6 and 7 and the radially inner regions of diaphragm springs 8 and 9 are pressed in the direction of the arrows 17 shown in FIG. 1, so that pressure chamber 10 becomes larger. Diaphragm springs 6 and 7 roll on the cover-mounted pivot ring 13 and on the housing-mounted pivot ring 15, so that the pivoting motion of diaphragm springs 8, 9 in relation to spring covers 6, 7 and housing ring 4 is not hindered. To prevent spring covers 6, 7 from resting on each other when the pressure reservoir is unpressurized, a seal retainer 18 is provided. The radially outer surface of seal retainer 18 is of circular form, so that it extends over the entire inner periphery of housing ring 4, and includes a connection fitting 20 on one side as an oil inlet.

The hydraulic pressure reservoir is connected through a valve (not shown) to a hydraulic system (not shown) by the connection fitting 20. A plurality of tongues 21 extend radially inwardly from the ring-shaped housing-mounted support 19. The tongues 21 serve as spacers between the spring covers 6, 7, to prevent the latter from resting directly flat against each other. If spring covers 6, 7 were in flat contact, the surface area pressurized with the pressure p within pressure chamber 10 would not be sufficient to press them apart against the force of the diaphragm springs. One or more tongues 21 serve at the same time to support a sensor system 22. The outer annular groove 12 of spring covers 6, 7 has a circumferential stop 23, which limits the travel of spring covers 6, 7 in the direction of the arrows 17. Starting at a certain distance in the direction of the arrows 17, the stops 23 contact the diaphragm springs 8, 9, so that the pressure force required for further movement of spring covers 6, 7 suddenly increases.

Figure 4:
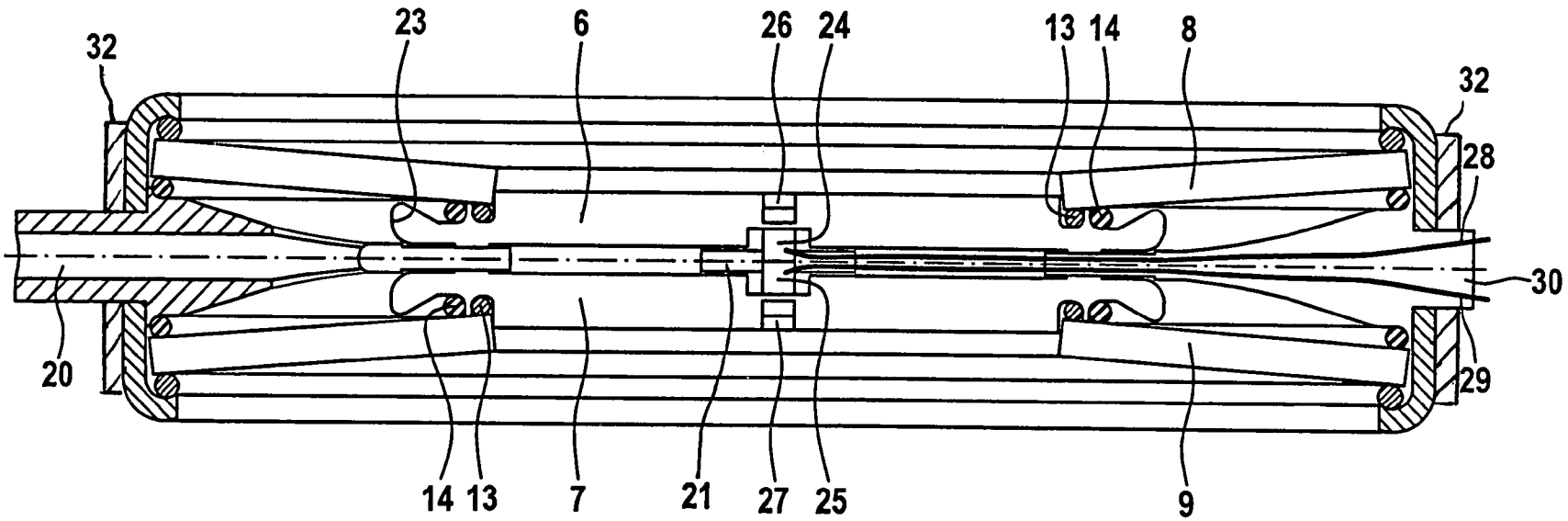
FIG. 4 is a cross-sectional view similar to FIG. 1 of an exemplary embodiment of a system of sensors within the pressure reservoir.

Sensor system 22 is shown in greater detail in FIG. 4, in addition to the showing in FIG. 1. As shown in FIG. 4 sensor system 22 includes a first sensor 24 and a second sensor 25. First sensor 24 is situated on a tongue 21 on the side facing spring cover 6; second sensor 25 is situated on the tongue 21 on the side facing spring cover 7. First sensor 24 and second sensor 25 are securely situated relative to the housing by being mounted on one of the tongues 21. A first magnet 26 is situated on spring cover 6; a second magnet 27 is situated on spring cover 7. First magnet 26 works together with first sensor 24, and second magnet 27 works together with second sensor 25. When spring covers 6, 7 move in the direction of arrows 17, the distances between first magnet 26 and first sensor 24 and between second magnet 27 and second sensor 25 change. That distance change is converted by sensors 24, 25 into an electrical signal, which represents the storage volume. The two sensors are situated redundantly, so that if one sensor fails the other sensor can continue to emit a pressure signal. In addition, the two signals of the sensors can be compared, so that a defect of a diaphragm spring, for example, or a mechanical impairment or the like, can be detected from the difference in the signals. Electric wires 28 from first sensor 24 and electric wires 29 from second sensor 25 are routed via one of the tongues 21 to a connector 30 on the housing.

FIG. 2 shows housing ring 4 in a separated, perspective view. It includes two identical ring portions, namely a first half-ring 31 and a second half-ring 32. The two half-rings are joined together by connecting means 33. The connecting means 33 can be screw flanges, for example. In the present exemplary embodiment a dovetail profile is provided in each case as the connecting means, which includes in each case a dovetail 34 and a dovetail-shaped recess 35. In order to assemble the hydraulic pressure reservoir, the spring package is stacked and pre-stressed. The half-rings are then placed around the spring package and the dovetail profiles at the ends of the half-rings are interconnected. The two half-rings 31, 32 are designed so that they do not become plastically deformed when they are bent slightly open in order to hook the dovetail profiles into each other. In that way it is possible to construct the reservoir without screws, welded seams, or other joining methods.

In addition to the above-described joinder of the housing ring parts by means of a dovetail joint, the two-part or multi-part housing ring segments can also abut each other without a positive lock. As shown in FIG. 4, the connection is supported by means of a band or ring 32 that surrounds the ring segments to secure them radially. Of course, a plurality of circumferential bands or tensioning rings can also be provided.

The sensors are mounted in the seal retainer or a tongue 21 of the seal retainer during injection molding of the seal retainer. The conductor paths for the electric wires 28, 29 for the sensors 24, 25 are also molded directly into the plastic of seal retainer 18 during injection molding, and are routed to the connector 30 to make contact with it. The two sensors assure redundancy in case one sensor fails. In addition, that redundancy makes it possible to ensure that neither of the two springs is overloaded in normal operation.

As an alternative to the above-described sensor system, the sensors can also be built into the spring covers, in which case the magnet is positioned in a tongue 21 of seal retainer 18, as shown in FIG. 1. However, in that arrangement an additional contact point must be provided between the housing and the sensors in order to conduct the sensor signal to the outside. Furthermore, the sensors must be molded into the spring covers. Because the spring covers must withstand significantly greater loads than the tongues 21, higher-quality plastic and correspondingly more expensive processing are needed. In an injection molding procedure for such higher-quality plastics, temperatures and pressures occur make it impossible to injection-mold around the sensors. In that case the sensors must therefore be installed as freestanding parts.

The spring covers 6, 7 are produced as injection-molded plastic parts, as die-cast aluminum parts, or as aluminum forgings. Magnets provided for the Hall sensors are integrated into the spring covers. In the case of plastic parts, the magnets can be included directly in the injection molding; aluminum parts must be installed later, for example by coining the edge of the aluminum material after inserting the magnet into a provided opening. The spring covers carry the pivot rings for the diaphragm springs, they include a seal surface for the seals between the spring covers and the diaphragm springs, and they form a mechanical stop for the diaphragm springs. The seals can be included in the injection molding, similar to the case of a seal retainer, if the spring covers are made of plastic. If the diaphragm springs are pressed in, starting from a certain position the stop 23 comes into contact with the diaphragm spring. That results in a point of application located further outside, which brings the spring cover to a stop despite the rising pressure. This brings about an additional safety function against overloading of the diaphragm springs, along with the sensor monitoring and a pressure-limiting valve located beside the reservoir.

Figure 3:
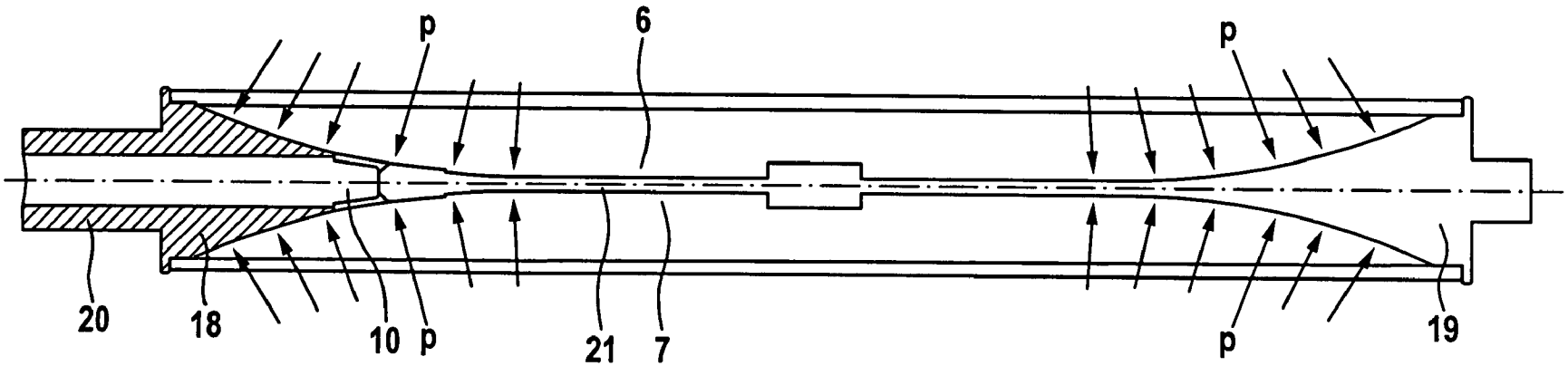
FIG. 3 is a representation of the pressure conditions of the pressure reservoir shown in FIG. 1.

FIG. 3 shows the pressure conditions in the exemplary embodiment of the pressure reservoir shown in FIGS. 1, 2, and 4. The arrows in FIG. 3 clearly show the pressure that is exerted on pressure chamber 10 by the diaphragm springs and spring covers 6 and 7. The pressure acts perpendicular to the surfaces in all cases. A large part of the pressure cancels itself out, with the small part that acts outward in the radial direction being absorbed by a large proportion of material at that location. In addition, the housing ring also lies around the seal retainer 18, and it can also absorb part of the radial deformation so that the strength demands on the material are very slight. Hence, this part can be produced of easily injectable material. It is therefore possible to operate with relatively low pressures and temperatures in the manufacturing process, which makes it possible to injection mold sensors in the middle of the spring covers, as illustrated in FIG. 4.

Of course, other methods than the sensor system with magnets just described can also be used to detect the distance between the spring covers, and thereby the stored volume. For example, an inductive solution can be chosen. In that case a large coil with a few windings can be integrated, for example, into the middle part, called the seal retainer, which coil is subjected to a modulated electrical signal. The spring covers must now be chosen of a material that damps the frequency in the coil, independent of the distance between spring cover and coil. Aluminum is an example of such a material. Such a sensor principle requires merely one coil with very few windings, and therefore can be manufactured more economically than a Hall sensor solution.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A hydraulic pressure reservoir comprising: at least one pressure chamber that is formed between two opposed, movable inner boundary members, each of which inner boundary members includes a spring cover and an abutting diaphragm spring that acts against the associated inner boundary member to urge it toward the opposed inner boundary member; and an outer boundary member peripherally surrounding the movable inner boundary members and having a U-shaped cross section along at least a part of its periphery, wherein the outer boundary member axially supports the diaphragm springs in a fixed axial position, and wherein each of the diaphragm springs includes a radially outer end that is pivotally supported by a housing-mounted pivot ring for pivotal movement of the radially outer end of the diaphragm spring relative to the outer boundary member and includes a radially inner end that is pivotally supported by a spring-cover-mounted pivot ring for pivotal movement of the radially inner end of the diaphragm spring relative to the inner boundary member.

2. A hydraulic pressure reservoir in accordance with claim 1, wherein the outer boundary member is a housing ring having a U-shaped cross section.

3. A hydraulic pressure reservoir in accordance with claim 2, wherein the housing ring is a two-piece component.

4. A hydraulic pressure reservoir in accordance with claim 3, wherein the housing ring includes two half-rings.

5. A hydraulic pressure reservoir in accordance with claim 2, wherein the housing ring includes three ring segments.

6. A hydraulic pressure reservoir in accordance with claim 5, wherein the housing ring includes three 120° ring segments.

7. A hydraulic pressure reservoir in accordance with claim 4, wherein the housing ring is divided in a plane that passes through an axis of rotation of a U-shaped cross section that defines a generating curve of the housing ring.

8. A hydraulic pressure reservoir in accordance with claim 7, wherein the ring segments are of identical construction.

9. A hydraulic pressure reservoir in accordance with claim 8, wherein the ring segments are joined together end-to-end in a positive connection.

10. A hydraulic pressure reservoir in accordance with claim 9, wherein the positive connection includes a dovetail joint.

11. A hydraulic pressure reservoir in accordance with claim 10, wherein the dovetail joint includes a dovetail-shaped component on one end of each of the ring segments and a correspondingly-shaped recess on an opposite end of each of the ring segments.

12. A hydraulic pressure reservoir in accordance with claim 11, wherein the dovetail joint includes means for radially securing the dovetail joint from radial separation.

13. A hydraulic pressure reservoir comprising: at least one pressure chamber that is formed between two opposed, movable inner boundary members, each of which inner boundary members includes a spring cover and an abutting diaphragm spring that acts against the associated inner boundary member to urge it toward the opposed inner boundary member; and an outer boundary member peripherally surrounding the movable inner boundary members and having a U-shaped cross section along at least a part of its periphery, wherein the outer boundary member is a housing ring in the form of a two-piece component including two half-rings and is divided in a plane that passes through an axis of rotation of a U-shaped cross section that defines a generating curve of the housing ring and axially supports the diaphragm springs in a fixed axial position, wherein the ring segments are of identical construction and ends of the ring segments abut each other without a positive lock and are supported by at least one tensioning member that peripherally surrounds the ring segments to provide radial retention of the ring segments about the inner boundary members.

* * * * *